United States Patent [19]

Foster

[11] 4,004,874

[45] Jan. 25, 1977

[54] APPARATUS FOR PRODUCTION OF CAST CONCRETE MEMBERS

[75] Inventor: Larry W. Foster, Franklin, Tenn.

[73] Assignee: Span-Deck, Inc., Franklin, Tenn.

[22] Filed: June 19, 1974

[21] Appl. No.: 480,944

[52] U.S. Cl. ..... 425/438; 249/50; 249/74; 425/440; 425/443

[51] Int. Cl.[2] ..... B28B 7/10

[58] Field of Search ..... 425/438, 440–441, 425/443–444; 249/50, 74–75, 162, 179, 180

[56] References Cited

UNITED STATES PATENTS

| | | | |
|---|---|---|---|
| 930,665 | 8/1909 | Henry | 249/74 |
| 1,097,234 | 5/1914 | Kempf | 249/179 |
| 3,168,771 | 2/1965 | Nelson | 240/50 |
| 3,645,490 | 2/1972 | Beasley | 249/50 |
| 3,815,861 | 6/1974 | Maier | 249/19 |
| 3,832,118 | 8/1974 | Mitchell | 249/161 |

FOREIGN PATENTS OR APPLICATIONS

| | | | |
|---|---|---|---|
| 1,271,007 | 7/1961 | France | 425/438 |

*Primary Examiner*—Richard B. Lazarus
*Assistant Examiner*—John McQuade
*Attorney, Agent, or Firm*—Cameron, Kerkam, Sutton, Stowell & Stowell

[57] ABSTRACT

Concrete structural members are cast in a metal mold form which comprises side members closed off by a horizontally extending resilient pallet. The side members have affixed thereto at their lower ends adjustable swivel arm actuating mechanisms adapted to flex the side members laterally away from one another to enable stripping of the cast member from the form. The resilient pallet forms the bottom surface of the mold form and etablishes a seal to prevent slurry leakage. The pallet is supported by a roller transfer assembly that enables the cast member to be transported to another operating station after the cast member has been stripped from the form. The transfer assembly is adjustable in height by means of a swing arm assembly which in addition to setting the depth of the casting also causes the cast member to be elevated clear of the form to enable it to be removed therefrom.

4 Claims, 5 Drawing Figures

APPARATUS FOR PRODUCTION OF CAST CONCRETE MEMBERS

BACKGROUND OF THE INVENTION

This application is an improvement upon the invention described and illustrated in copending, commonly owned application Ser. No. 251,358, filed May 8, 1972, now U.S. Pat. No. 3,832,118.

The subject matter of said copending application Ser. No. 251,358 is hereby incorporated herein by reference.

This invention relates to the manufacture of shaped cast concrete structural members which may take the form of rectangular slabs, T-slabs or multiple T-slabs. In the interest of brevity, such shaped structural members are hereinafter referred to generally as slabs.

In the casting of concrete slabs, mold forms are employed which are open at the top for reception of the fluid concrete mix. When the fluid concrete mix is set and the cast product is to be removed from the mold, it must be possible to establish clearance betwen the product and the sidewalls of the mold to strip the product therefrom. This stripping clearance heretofore has been obtained by a variety of ways.

One particularly advantageous arrangement is described in the aforementioned pending application Ser. No. 251,358 wherein the side members are sprung away after casting by a cam mechanism disposed beneath the mold form.

In the fabrication of cast concrete structural members by apparatus such as described in the aforementioned copending application Ser. No. 251,358, prior to the raising of the cast slab out of its form, the side walls of the form must be separated from the sides of the slab. This is accomplished in the apparatus of the copending application by means of a cam arrangement shown therein in FIG. 7. This cam arrangement includes a flat cam plate having pairs of oppositely oriented slots within which are received pins depending from the vertical sides of the mold form. The force exerted on pin members by the sides of adjacent slots as the cam plate is displaced, causes the pins to be displaced and a corresponding movement is translated to the sides of the mold form.

While the foregoing cam arrangement provides an effective means of springing the side members of the form from the cast stem, it is subject to serious disadvantages. For example, because of the adhesive forces existing between the forms and the concrete, large forces must be developed to effect separation thereof. These forces are translated through the slot edges and pin members resulting in rapid wear of the elements unless resort is made to heavy structural members. This in turn undesirably increases the cost of the form.

Another disadvantage of the aforementioned copending application Ser. No. 215,358 is that the ball member cam follower of elevating mechanism concentrates the weight of the concrete over a small area and the resultant sliding friction between the cam follower and cam causes rapid wear of the elements. To this end, it should be appreciated that when casting structural members in a form which extends 500 feet in length, the total weight of the cast member may approach 180,000 pounds.

These disadvantages are overcome by the present invention which is particularly concerned with improvements upon the side wall springing mechanism and elevating mechanism of the apparatus shown and described in the aforementioned copending application Ser. No. 251,358, to enable the production of slabs more efficiently and more economically and which provides a greater flexibility in the utilization of the apparatus.

Another problem encountered with forms for casting slabs in slurry leakage frequently occurs at the mating edges of the side members of the form and the pallet. Such leakage results in discoloration and/or flashing of the cast product or the formation of "icicles" which make the product unacceptable without further and costly steps.

The problem becomes particularly noticeable in the fabrication of slabs wherein the horizontal pallet is adjustable in height between the side members of the form. A height adjustment of the pallet is extremely desirable in order to accomodate the form to the fabrication of slabs of various sizes and provides a distinct advantage over conventional slab construction wherein the pallet of the form is blocked up to fabricate slabs with a desired length of stem. However, inasmuch as the sides of the form have a small gradually increasing taper, a small leakage space results when the pallet is elevated substantially within the sides of the form, as would be the case when fabricating a short stem T-slab. Further, because holding means are generally provided at the lower end of the form sides, there is a tendency for the sides to bow because of the resiliency of the relatively thin sides of the form. This bowing is further aggravated by the weight of wet concrete. Resort to the use of conventional sealing gaskets along the edges of the pallet is ineffectual to compensate for the bowing effect and resultant leakage. In accordance with the present invention, this leakage problem is overcome by resort to the use of a resilient, expandable pallet which allows a greater latitude of height adjustment.

SUMMARY OF THE INVENTION

These and other disadvantages of prior art casting forms are overcome by the present invention which provides improved actuating mechanisms for a mold form by which a cast slab may be stripped therefrom and transported in an efficient manner and by which slabs of varying dimensions can be economically fabricated.

To this end, it is a primary object of the present invention to provide an improved apparatus for casting shaped concrete structural members which facilitates the stripping of cast slabs from the mold form and which enables the height and width of the cast slab to be readily controlled.

Another object of the present invention is to provide an improved apparatus for the production of shaped cast concrete members which reduces to a minimum the time and labor required to manufacture the cast members.

Still another object of the present invention is to provide an improved apparatus for the production of shaped cast concrete members having a greater latitude in height adjustment than heretofore available in conventional mold forms.

The apparatus of the present invention is characterized in that concrete slabs are cast in forms comprising vertical side sections closed at the bottom by a resilient horizontal pallet or form member which is vertically adjustable. The pallet includes supporting rollers adapted to ride on an elevating actuating mechanism assembly comprising a horizontally extending pull bar or plate and a swing arm assembly which raises or lowers the support plate. The vertical side sections of the form, have connected thereto swivel arms adapted to be actuated upon setting of the concrete to cause relative movement between the side plates and cast member sufficient to spring the side forms clear of the cast member and permit stripping of the cast member from its form. After the side forms are sprung, the swing arm assembly may be actuated to cause the slab to be raised clear of the form and transferred by a supporting roller to a further processing area.

BRIEF DESCRIPTION OF THE DRAWINGS

The invention may be more readily understood by reference to the following drawings wherein like parts are identified by like reference characters throughout the several views and wherein.

DESCRIPTION OF THE PREFERRED EMBODIMENT

As hereinbefore mentioned, this application is an improvement upon the apparatus described and illustrated in copending application Ser. No. 251,358 which is incorporated herein by reference.

The aforementioned copending application Ser. No. 251,358 describes a structural arrangement of a stress frame and mold form employing a horizontally movable slotted cam cooperating with pin members depending from the sides of the mold form for springing the side members clear of the cast member and permit stripping of the cast member from its form. A stepped cam and cam follower mechanism is provided for raising the slab clear of the form.

In the present invention, the slotted cam mechanism is replaced by an adjustable swivel arm device, while the stepped cam is replaced by an adjustable swing arm assembly. In addition, the pallet of the apparatus of the present invention is made of resilient material to minimize leakage of slurry. It should be readily apparent to those skilled in the art that the stress frame and mold form of the present invention is readily adapted to be mounted on cross members, such as cross member 72 of the apparatus illustrated in the aforementioned copending application Ser. No. 251,358, and thus adaptable for use in a movable bed process of the type described in U.S. Pat. No. 3,523,343. Alternatively, the stress frame and mold form may be fixed for use in a fixed bed process of the type described in U.S. Pat. No. 3,217,375.

Figure 1:
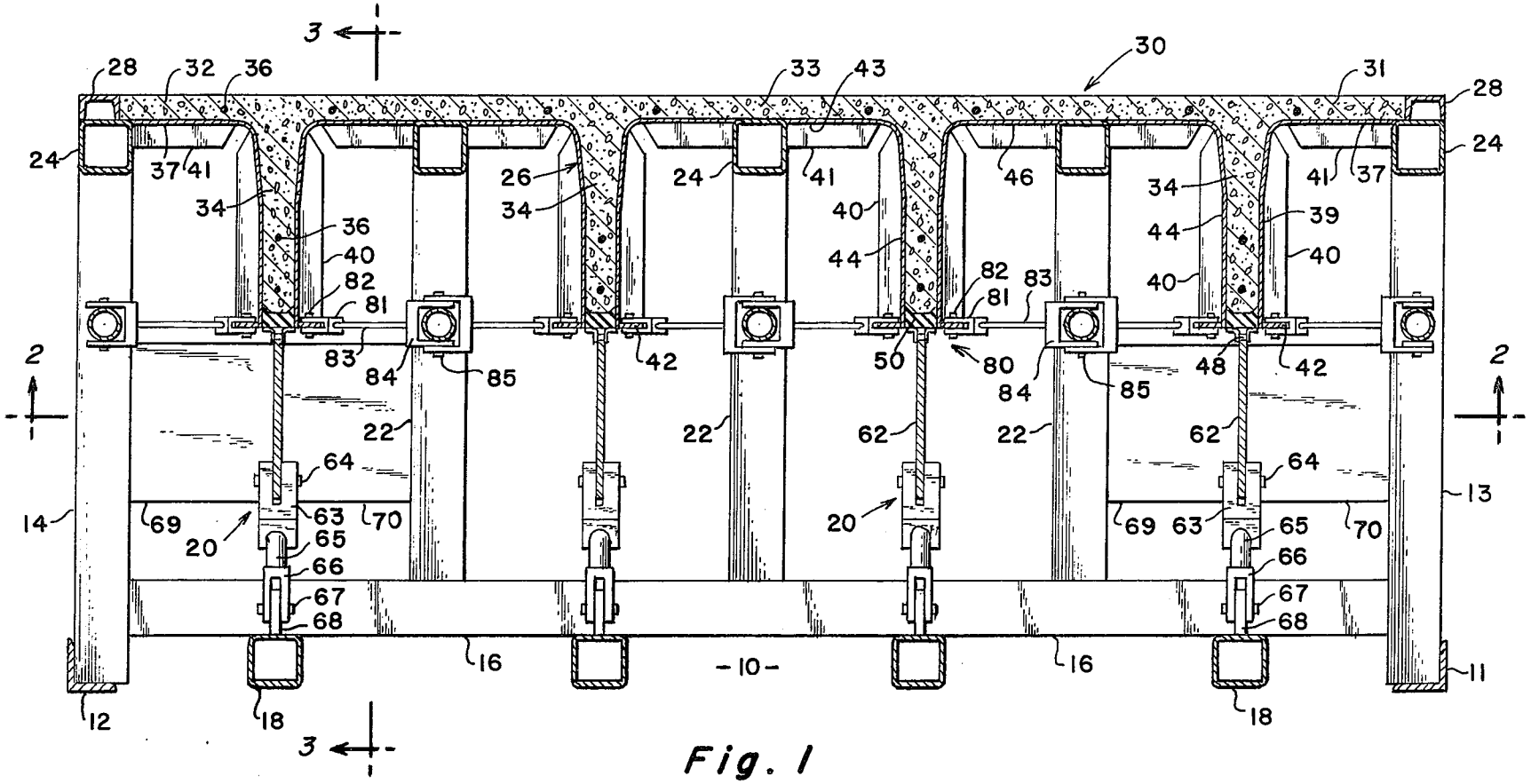
FIG. 1 is a fragmentary, partially in cross-section, front elevational view, of a stress frame and mold form for manufacturing shaped cast concrete members in accordance with the present invention.

Referring to the drawings of the present invention, the apparatus is illustrated for clarity as being at a fixed location and comprises, as shown most clearly in FIG. 1, a stress frame 10 which in a typical installation extends for a length of five hundred feet. Stress frame 10 comprises an open framework including base angle iron members 11 and 12 disposed at opposite sides of the framework and extending along the length thereof. Base members 11 and 12 each support a plurality of outer vertical rectangular tubular supports 13 and 14. Supports 13 on the right hand side of the framework as viewed in the drawing are spaced on five foot centers as are supports 14 on the left side of the framework. Oppositely facing supports 13 and 14 have fixed thereto by welding or the like lateral structural supports 16 which in turn support longitudinally extending rectangular tubular structural members 18. Members 18 are spaced on two foot centers and each support along the length thereof a plurality of height adjusting elevating linkages 20. Between the outer vertical supports 13 and 14 and between each pair of elevating linkages 20, there are provided a plurality of vertical form supporting structural members 22, the lower ends of which are affixed to and supported by lateral supports 16. These vertical members 22 along with the left and right end and outer vertical support members 13 and 14 each support a longitudinally and horizontally extending rectangular tubular structural member 24 to which the mold form 26 is skip welded.

For convenience, the framework has been illustrated in connection with a mold form for fabricating multiple T-slab members of the quad T type; however, it should be readily apparent that the structure may be modified to assemble the fabrication of other shape slabs such as, for example, rectangular, single T, or double T and so forth, and it is not intended by the illustration to limit the invention to apparatus suitable for only the fabrication of quad T slabs.

As most clearly shown in FIG. 1, mold form 26 comprises at least a pair of outer inverted L shaped metal form members 37 and one or more inverted U shaped metal form members 43 if a multiple T-slab is to be cast. As should be readily appreciated, the number of U-shape members making up the composite form is determined by the desired cross sectional shape of the structural members. For a simple T cross sectional slab, no U-shaped forms are necessary and only two inverted L-shaped forms are arranged with the side members spaced from each other a desired distance to cast the T member having the desired stem width. For a double T-slab, a single U-shape form is required, for a triple T-slab, two U-shape forms are required and so forth.

Because of the great length of the stress frame, it is preferable to divide the form into sections of 10 and 15 feet in length and to mount each section individually. The sections are thereafter connected together to cast a continuous slab of approximately five hundred feet in length. After the concrete has cured, the slab may be stripped from the form and transported to a saw mill where it is cut to desired lengths. However, the length of the slab cast may vary as desired, depending on the overall length of the form. Channel members 28 or other suitable blocking devices are utilized to contain the wet concrete at the open ends of the T section while the open ends of opposite ends of the form are sealed by bulkheads (not shown).

Figure 4:
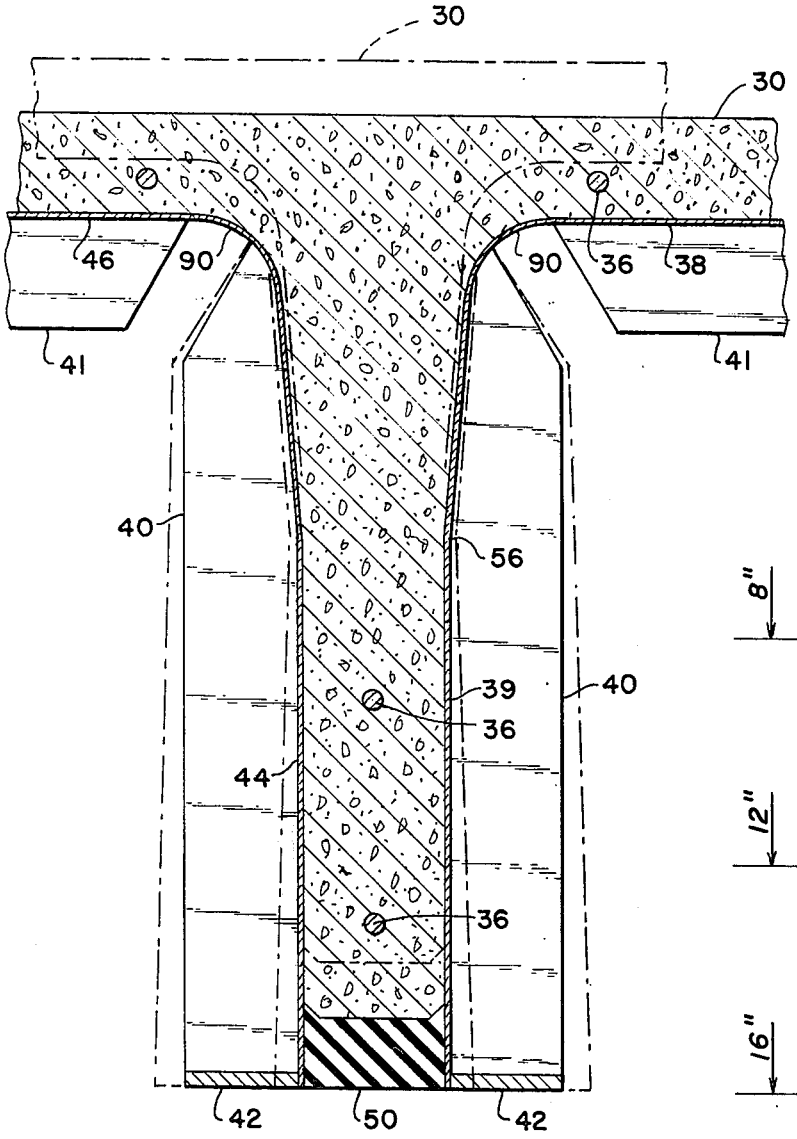
FIG. 4 is a fragmentary sectional view of a slab fabricated with the apparatus of the present invention, emphasizing in phantom, the flexure of the form sides.

FIG. 1 illustrates a composition form 26 for casting a quad T slab 30 comprising outer canter-lever arm sections 31, 32, intermediate section 33 and four depending leg members or stems 34. As shown in FIGS. 1 and 4, slab 30 may include one or more stressing strands or cables 36, suitable in size and strength and distributed as desired to provide a desired amount of pre-stress or reinforcement of the slab. For simplicity, only a few cables have been shown in the lower portion of the stem and distributed in the arm sections; however, it should be readily apparent that additional cables may be distributed along the stem and also along the arm sections as desired. The cables extend the entire length of the mold form. For prestressing, the cables are anchored at one end and tensioned at the other end by a suitable tension or jacking device in a manner well known in the art. If desired, laterally extending reinforcing rods may be provided across the slab surfaces to meet the strength requirements of a particular design for which the slab is to be used.

As shown in FIG. 4, each L shape form member 37 includes a horizontally disposed arm supporting extension 38 and a vertically disposed stem forming section 39, the lower end of which may be turned over or have welded thereto a steel support piece 42 to provide a shoulder or ledge supporting a stem stiffening member 40. Several members 40, along with several horizontal arm stiffeners 41, are spaced lengthwise along the form and affixed thereto by welding or the like. Stiffeners 40 and 41 are spaced from each other at the juncture of the arm and the stem sections of the form to allow flexing thereof as shown by the dash lines in FIG. 4.

Each U-shape form member 43 is similarly constructed and includes a pair of vertically disposed stem forcing sections 44 joined by horizontally disposed intermediate section 46.

As shown in FIG. 4, side members 39 and 44 of the form are formed by adjacent vertically disposed sections of either two inverted L shaped sections or an inverted L shaped section and an inverted U-shaped section. The side members are closed off at their lower ends by a resilient, expandable pallet 50. Pallet 50 is fabricated of rubber and is relatively stiff, having a durometer reading of approximately 70. Pallet 50 should be readily expandable under the weight of wet concrete poured into the mold between the side members to provide an efficient seal. As shown in the drawings, particularly FIGS. 4 and 5, pallet 50 is substantially rectangular in cross section, but has its upper left and right hand edges, 53 and 54, respectively, as viewed in the drawing, raised to form a cup shaped face 55. This cap shaped face enhances the expansion of the pallet material due to the weight of the concrete that sits in the dish and presses the rubber lips 53 and 54 snugly against the inner sides of the side members 39 and 44.

In accordance with a preferred embodiment of the subject invention, slabs of varying dimension may be formed, depending of the elevation of pallet 50 and spacing of side members 39 and 44. In a typical installation of the apparatus embodying this subject invention, T slabs are fabricated having stems varying from 8 inches to 16 inches in length and a width of approximately 2-½ inches at the lower extremity gradually increasing to about 2-¾ inches at the start of draft 56. Pallet 50 is constructed to snugly fit the opening between the side members at the lower most extremities and provides a tight seal to prevent slurry leakage. As the pallet is elevated in position to form a shorter stem, a slight spacing exists between the side members and the pallet. Leakage, however, is minimized in that the rubber material of the pallet 50 readily expands due to the weight of the wet concrete forcing the sides of the pallet and lips 53 and 54 into sealing relationship with the inner sides of the side members 39 and 44.

Figure 5:
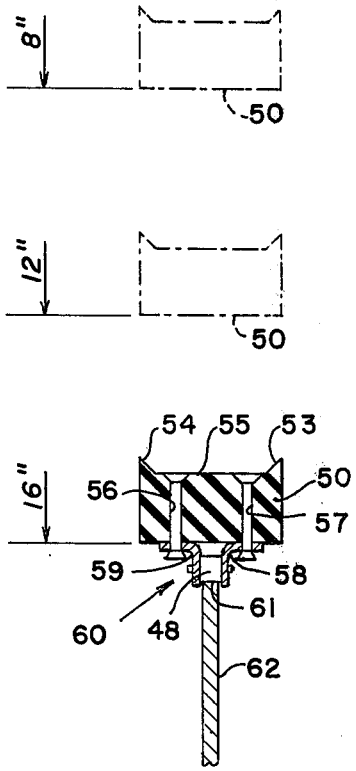
FIG. 5 is a detail sectional view of the supporting pallet of the mold form.

As shown in FIG. 5, pallet 50 is mounted to a conventional chain roller transfer mechanism 60 supported on the upper surface 61 of support plate 62. To this end, pallet 50 includes through holes 56 and 57 conveniently counter sunk on the cup face of the pallet. The other face of the pallet is flat and rests on oppositely facing right angle links 58 and 59 mounted to rollers 48. Links 58 and 59 include apertures, now shown, through which suitable bolts or rivets may be passed for fastening of the pallet thereto. Pallets 50 may be elevated between its lowermost position shown in FIG. 5 and an upper position to vary the length of the stem of the cast member. The adjustment is continuous throughout the limits set by the uppermost and lowermost positions. In accordance with the preferred embodiment, the limits are set for forming stems of eight to sixteen inches as shown by the dotted extensions of pallet 50.

Figure 3:
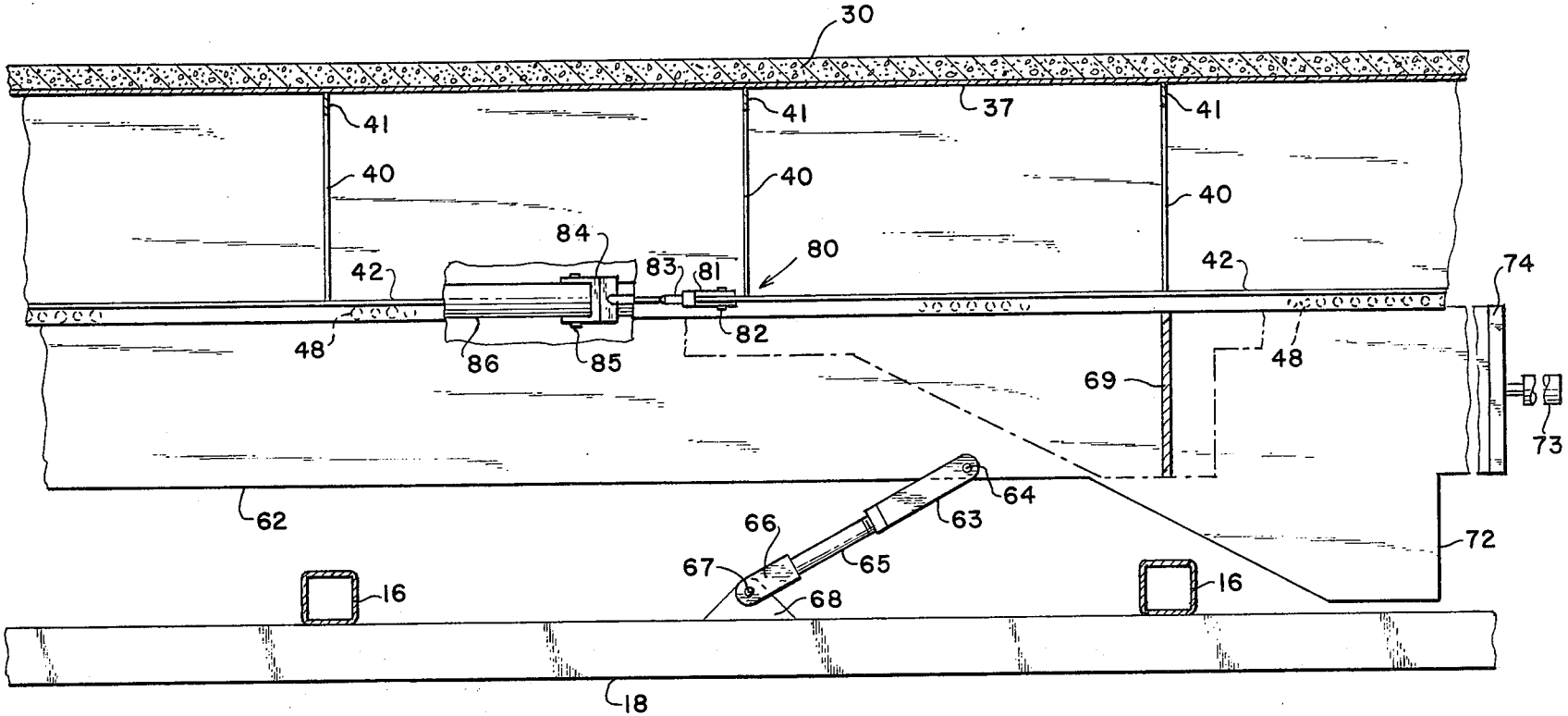
FIG. 3 is a fragmentary, end elevational view, taken along lines 3—3 of FIG. 1.

The height adjusting and elevating linkage 20 is best shown in FIG. 3 and includes a swing arm assembly comprising yoke 63 journaled on pin 64 which extends through support plate 62. Yoke 63 threadingly receives one end of a threaded arm or bar 65, the other end of which has connected thereto a yoke 66 journaled on pin 67 extending through plate 68. Plate 68 is mounted to the upper surface of a structural member 18.

Support plate 62 extends the length of the framework and is supported by a plurality of swing arm assemblies, the swivel points of which are spaced on five foot centers. Depending from support plate 62 at 10 foot intervals is an extension or haunch plate 72 which guides the support plate as it is being moved to its raised position. To this end, a pair of spaced guide plates 69 and 70, only four of which are shown in FIG. 1, are provided for guiding the support plate. Guide plates 69 and 70 extend vertical members 13 and 22 at ten foot intervals and are slightly spaced from each other at their ends to allow passage of the support plate. Similar guide plates may be provided on interval supports 22. As the support plate is raised upon actuation of these swivel arm assemblies, haunch 72 assumes a position between the guide plates as shown by the dash lines in FIG. 3. It should be noted, in the absence of haunch plate 72, substantially the entire support plate would be clear of the gude plate as the support plate is elevated which could cause serious instability problems in the support and guides 69 and 70 and haunch plate 72 povide a convenient means for guiding the slab support plate.

Actuation of the elevating mechanism is effected by hydraulic cylinders 73 having their operating arms connected to an operating bar 74 which commonly connects the several support plates 62 as shown, for example, in FIG. 3.

Figure 2:
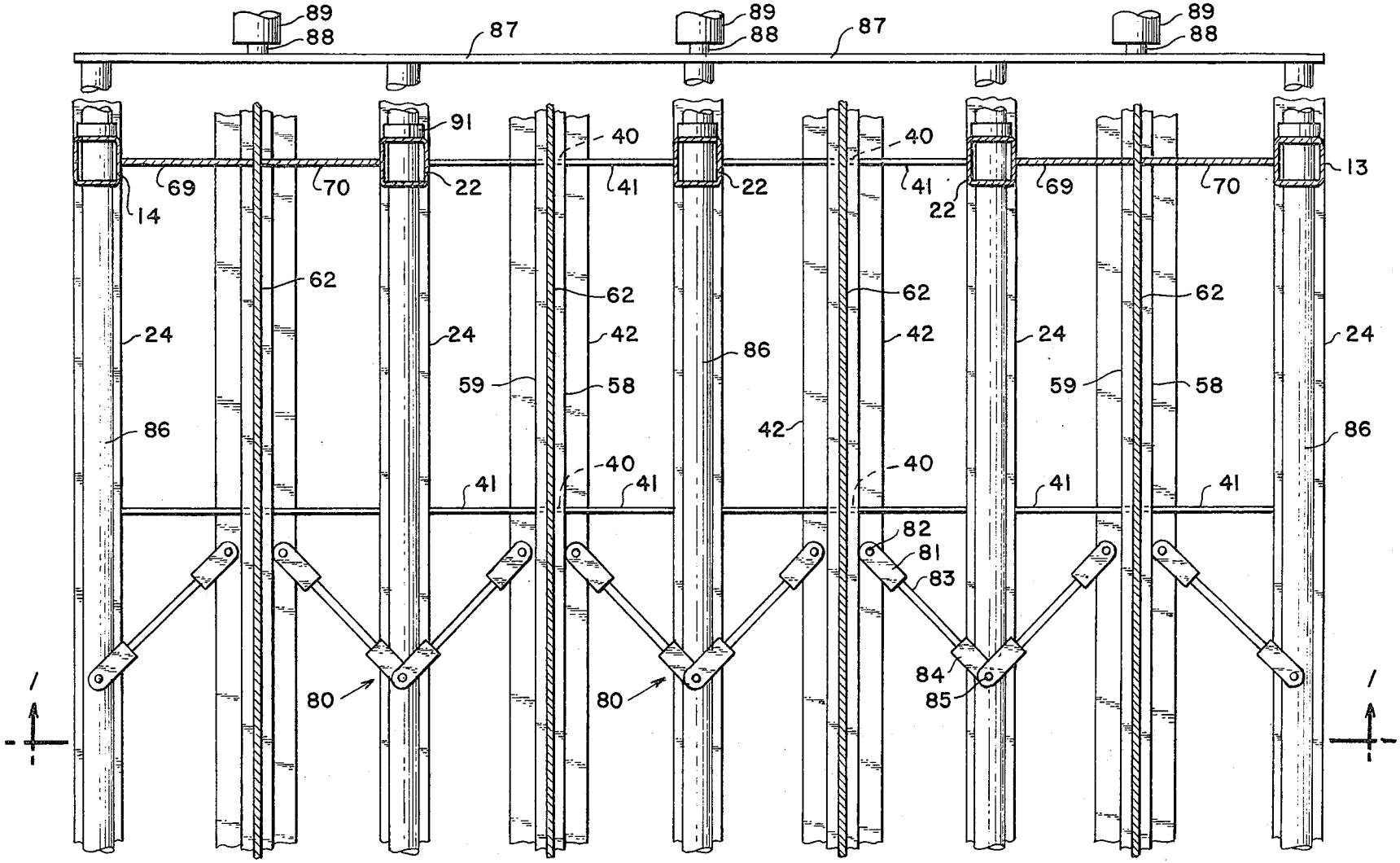
FIG. 2 is a fragmentary, plan view taken along line 2—2 of FIG. 1, with certain parts removed for clarity.

Stripping of the cast slab is advantageously affected upon actuation of the adjustable swivel arm actuating mechanisms 80 shown most clearly in FIGS. 1 and 2. Each pair of adjacent side members 39, 44 have connected thereto at their lower ends yoke 81 which may be journaled on pin 82 extending through the ledge 42. Yoke 81 includes a threaded aperture into which is threaded one end of adjusting rod 83. The other end of rod 83 has threaded thereon a U-clamp 84 the ends of which are journaled on a pin 85 extending through actuating bar or pipe 86. Each bar 86 extends horizontally the length of the form and passes through openings provided in structural members 24. At each opening, a guide flange 91 having a diameter slightly greater than that of the pipe at one end, pipe 86 is commonly connected to an actuating bar 87 which in turn is connected to the arms 88 of one or more hydraulic cylinders 89.

Conventionally, a normal time cycle of operation for casting a concrete structural member such as a quad T may take 10 to 12 hours. Of this time, approximately two and a half hours are necessary for the stripping operation. This time is greatly shortened by the present invention. Usually, at the start of a new work shift, the cast slab has cured. In accordance with the present invention, after the slab is cured, the slab is stripped by actuation of the hydraulic cylinders 89 causing bars 86 to be drawn in the direction whereby yokes 81 are caused to exert a lateral force on the side members. As shown in FIG. 4, the side members are sprung from the lower ends of the slab, pivoting about a point 90 at the juncture of the stem and arm of the form. Once the side members are freed, hydraulic cylinders 73 are actuated to cause swing arm assemblies 20 to raise pallet 50 about one inch above form. The slab is then transferred by its roller assembly to an operating station. Inasmuch as the pallet and roller assembly are free of both the slab and the elevating mechanisms, it is conveniently separated for reuse for cleaning. While the pallet is being cleaned, a spare pallet may be utilized in the next pouring operation with the cleaned form. The entire stripping operation takes about 10 to 15 minutes. After stripping, the forms are cleaned and layed out to receive another pouring.

Although the invention has been described and illustrated in the accompanying drawings with regard to a particular embodiment, it will be apparent to those skilled in the art that various changes may be made in the details of construction of the various elements of the system without departing from the inventive concept. Accordingly, reference therefor should be made to the appended claims which are intended to define the full scope and spirit of the invention.

I claim:

1. Apparatus for the production of cast concrete structural members comprising a stress frame, a mold form open from the top to receive a fluid concrete mix and carried by said frame, said mold form including at least one pair of substantially vertically disposed spaced side members closed off at opposite end and a horizontally disposed pallet closing off the lower end of the mold form, a side member springing mechanism for flexing said side members laterally away from each other at the lower ends after the concrete mix has been set in said form, said springing mechanism including a first yoke pivotally connected to the lower end of one of said side members of a pair, a second yoke pivotally connected to the lower end of the other of said side members of said pair, a first and a second connecting rod each affixed at one end to said first and said second yokes, respectively, a third yoke connected to the other end of said first connecting rod, a fourth yoke connected to the other end of said second connecting rod, a drive bar, means pivotally connecting said third and said fourth yokes to said drive bar, means connected to said drive bar for actuation thereof from a first to a second position to affect flexing of said side members, a swing arm assembly for supporting said pallet, said swing arm assembly adapted to be activated to elevate the pallet and the cast member after the concrete mix has been set in said form and the side members flexed to enable the cast member to be removed from the form, said swing arm assembly including a longitudinally extending support plate depending from said pallet, a plurality of spaced frist yokes disposed beneath said support plate and being pivotally connected to said support plate, a plurality of spaced second yokes pivotally connected to said stress frame and a plurality of connecting rods each connected at opposite ends to one of said plurality of first yokes and one of said plurality of second yokes, hydraulic actuating means connected to said support plate for displacing said support plate lengthwise of the form and thereby activating said swing arm assembly to elevate said pallet and the cast member set in the form.

2. Apparatus as set forth in claim 1 wherein said first and said second connecting rods of the springing mechanism are threaded at opposite ends and said first and said second yokes are correspondingly threaded to receive the threaded ends of said rods.

3. Apparatus as set forth in claim 1 wherein each of said plurality of connecting rods of said swing arm assembly is threaded at one of its ends and each of said plurality of said first yokes is correspondingly threaded to receive the threaded end of said rod.

4. Apparatus as set forth in claim 1 wherein said support plate includes a plurality of depending haunches, and wherein spaced pairs of laterally extending guide plates are affixed to the frame and spaced from each other on opposite sides of the support plate for guiding the support plate and maintaining the form stabilized when the pallet is elevated.

* * * * *